US008045882B2

(12) United States Patent
Delcamp et al.

(10) Patent No.: US 8,045,882 B2
(45) Date of Patent: Oct. 25, 2011

(54) SELF-SEALING PROCESS ROLLER

(76) Inventors: Jesse Delcamp, Tampa, FL (US); Steven Miller, Pinellas Park, FL (US)

( * ) Notice: Subject to any disclaimer, the term of this patent is extended or adjusted under 35 U.S.C. 154(b) by 51 days.

(21) Appl. No.: 12/247,801

(22) Filed: Oct. 8, 2008

(65) Prior Publication Data

US 2009/0035011 A1 Feb. 5, 2009

(51) Int. Cl.
*G03G 15/08* (2006.01)

(52) U.S. Cl. ..... 399/103; 399/286

(58) Field of Classification Search ..... 399/103, 399/106, 265, 279, 284, 286; 347/140
See application file for complete search history.

(56) References Cited

U.S. PATENT DOCUMENTS

| | | | | |
|---|---|---|---|---|
| 6,064,463 | A * | 5/2000 | Yamada et al. | 399/284 X |
| 6,487,383 | B2 * | 11/2002 | Buchanan et al. | 399/103 |
| 6,496,668 | B2 * | 12/2002 | Sato et al. | 399/103 |
| 6,615,006 | B2 * | 9/2003 | Michlin et al. | 39/103 X |
| 6,937,831 | B2 * | 8/2005 | Kamimura | 399/103 |
| 6,985,683 | B2 * | 1/2006 | Foster et al. | 399/103 |
| 7,197,259 | B2 * | 3/2007 | Ohshika | 399/103 |
| 7,251,435 | B2 * | 7/2007 | Ohgoshi et al. | 399/103 |
| 7,630,666 | B2 * | 12/2009 | Nakaya et al. | 399/103 |

* cited by examiner

*Primary Examiner* — Sandra Brase
(74) *Attorney, Agent, or Firm* — Jesse Delcamp

(57) ABSTRACT

A process roller for use with an imagining cartridge, the process roller including sealing surfaces located at its distal ends. As the process roller rotates, the sealing surfaces of the process roller are sufficiently flexible to conform to the inner side walls of the imaging cartridge, thereby sealing the printing agent inside the imaging cartridge at the distal ends of the process roller.

9 Claims, 12 Drawing Sheets

SELF-SEALING PROCESS ROLLER

BACKGROUND OF THE INVENTION

Laser printers use a coherent beam of light, hence the term "laser printer," to electrostatically charge discrete portions of an image transfer drum thus attracting a printing agent such as toner. Toner is a mixture of pigment (most commonly black) and plastic particles. The toner becomes electrostatically attracted to a process roller such as a developer roller, which transfers toner to the charged portions of the image transfer drum. The toner is transferred to paper, or other printing medium, as it passes over the rotating image transfer drum. Subsequently, the paper is heated so that the plastic is melted thereby permanently affixing the ink to the paper.

The vast majority of commercially available desktop laser printers include replaceable or removable toner cartridges that incorporate a wastebin assembly and a toner hopper assembly. The wastebin assembly contains the image transfer drum and a toner reservoir for waste toner. The toner hopper assembly holds the toner and has the developer roller rotatably mounted at its toner exit area. To keep the toner from spilling out of the toner hopper, prior art toner cartridges incorporate developer roller seals that are installed in the toner hopper, which act to seal the ends of the developer roller. These developer roller seals are susceptible to being catastrophically displaced due to friction between the seal and the developer roller. Also the prior art developer roller seals are additional parts that must be manufactured and installed into the cartridge, raising development and assembly costs of the cartridge.

Therefore, what is needed is an imaging cartridge that utilizes a developer roller that seals itself against the housing of the toner hopper, eliminating the need for separate developer roller seals.

SUMMARY OF THE INVENTION

The long-standing but heretofore unfulfilled need for a process roller that seals itself against the housing of an imaging cartridge, thereby limiting the number of elements required during manufacture, and which also includes improvements that overcome the limitations of prior art imaging cartridges is now met by a new, useful, and non-obvious invention.

In one embodiment, the toner exit area of the toner hopper is sealed at the distal ends of the developer roller by circumferential sealing lips located on the distal end of the developer roller. The length of the developer roller, including the circumferential sealing lips, is greater than the distance between the two inner side walls of the toner hopper, causing the circumferential sealing lips to be compressed slightly by the hopper's inner side walls. When compressed, the circumferential sealing lips flare outward slightly, forming a seal against the inner side walls. As the developer roller rotates, the circumferential sealing lips are sufficiently flexible and elastic to conform to the inner side walls of the hopper.

The upper portion of the toner exit area is sealed by a doctor blade which is biased toward the developer roller by a spring. The bottom surface of the doctor blade contacts the upper surface of the developer roller, metering the proper amount of toner onto the developer roller. The ends of the doctor blade are sealed by electrically conductive foam end seals that are compressed between the distal ends of the doctor blade and the inner side walls of the hopper. The electrically conductive foam end seals extend from the upper surface of the doctor blade to the bottom surface of the doctor blade and contact the upper surface of the develop roller. The electrically conductive foam end seals act to meter the toner on the portion of the developer roller with which they are contacting.

The lower portion of the toner exit area is sealed by a lower sealing blade that contacts the developer roller along a substantial length of the developer roller. The lower sealing blade is adhered to a ramp surface of the toner hopper located below the developer roller. The lower sealing blade extends upward from the ramp surface and contacts the lower surface of the developer roller to allow the toner on the developer roller to enter back into the hopper, while not allowing the toner in the hopper to exit. The ends of the lower sealing blade are sealed by foam seals mounted under the lower sealing blade.

In another embodiment, the distal ends of the developer roller are sealed by circumferential sealing cavities located in the distal ends of the developer roller. The perimeter walls of the sealing cavities contact surfaces of the hopper located at the distal ends of the developer roller to form a seal. As the developer roller rotates, the circumferential sealing cavities are sufficiently flexible and elastic to conform to the mating surfaces of the hopper.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

Figure 1:
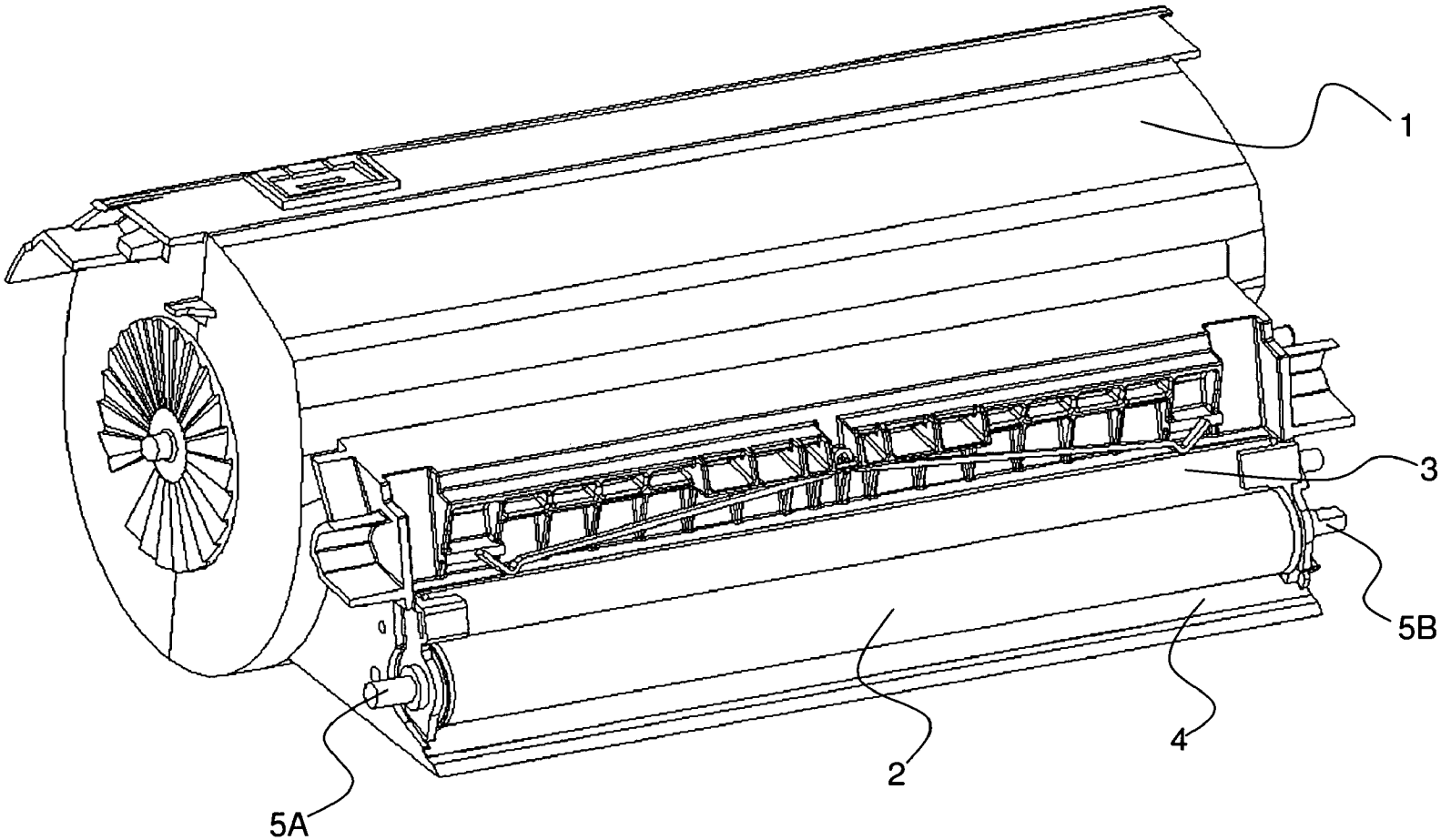
FIG. 1 is a perspective view of the toner hopper.
Figure 2:
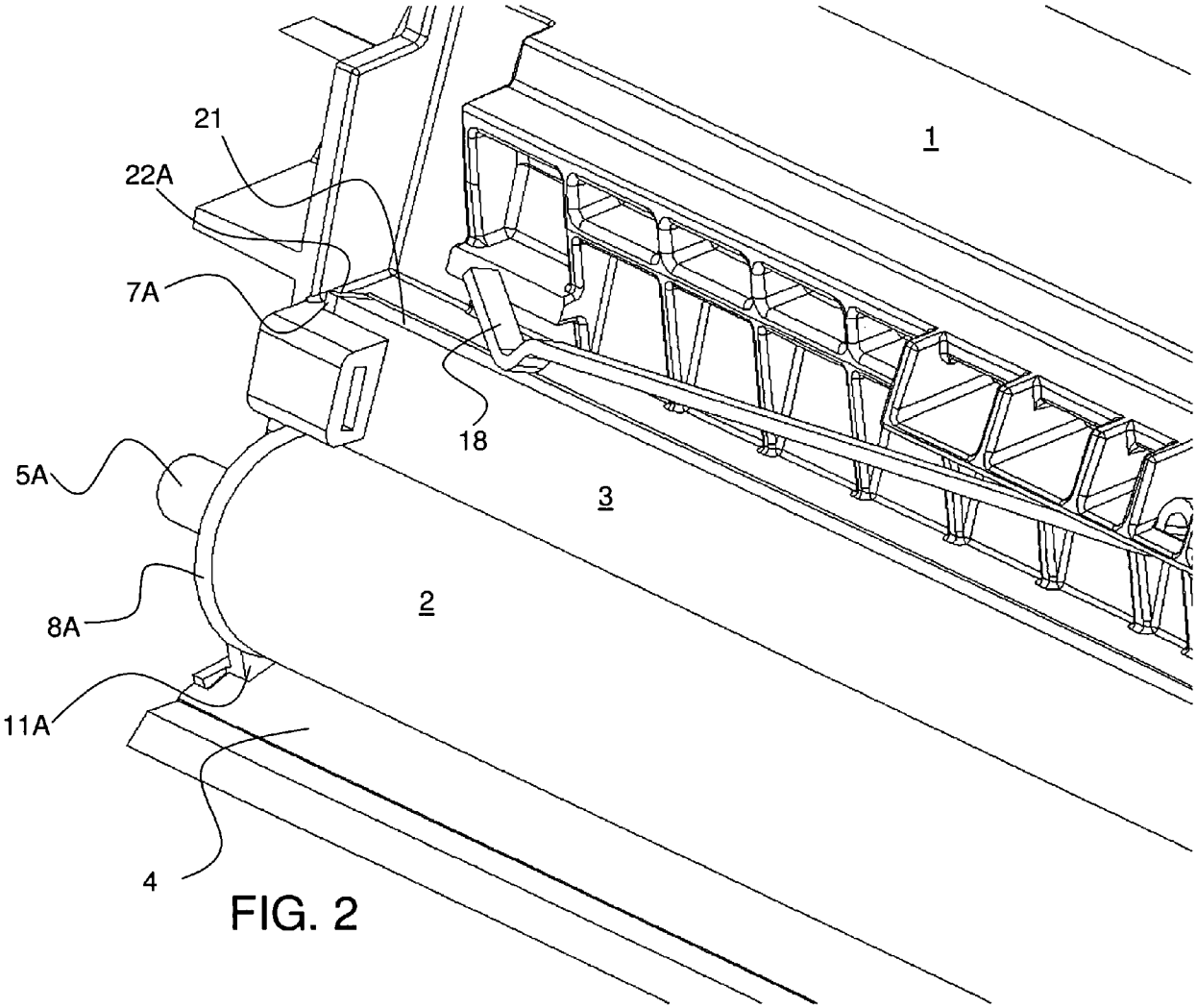
FIG. 2 is a close-up view of the toner hopper.
Figure 3:
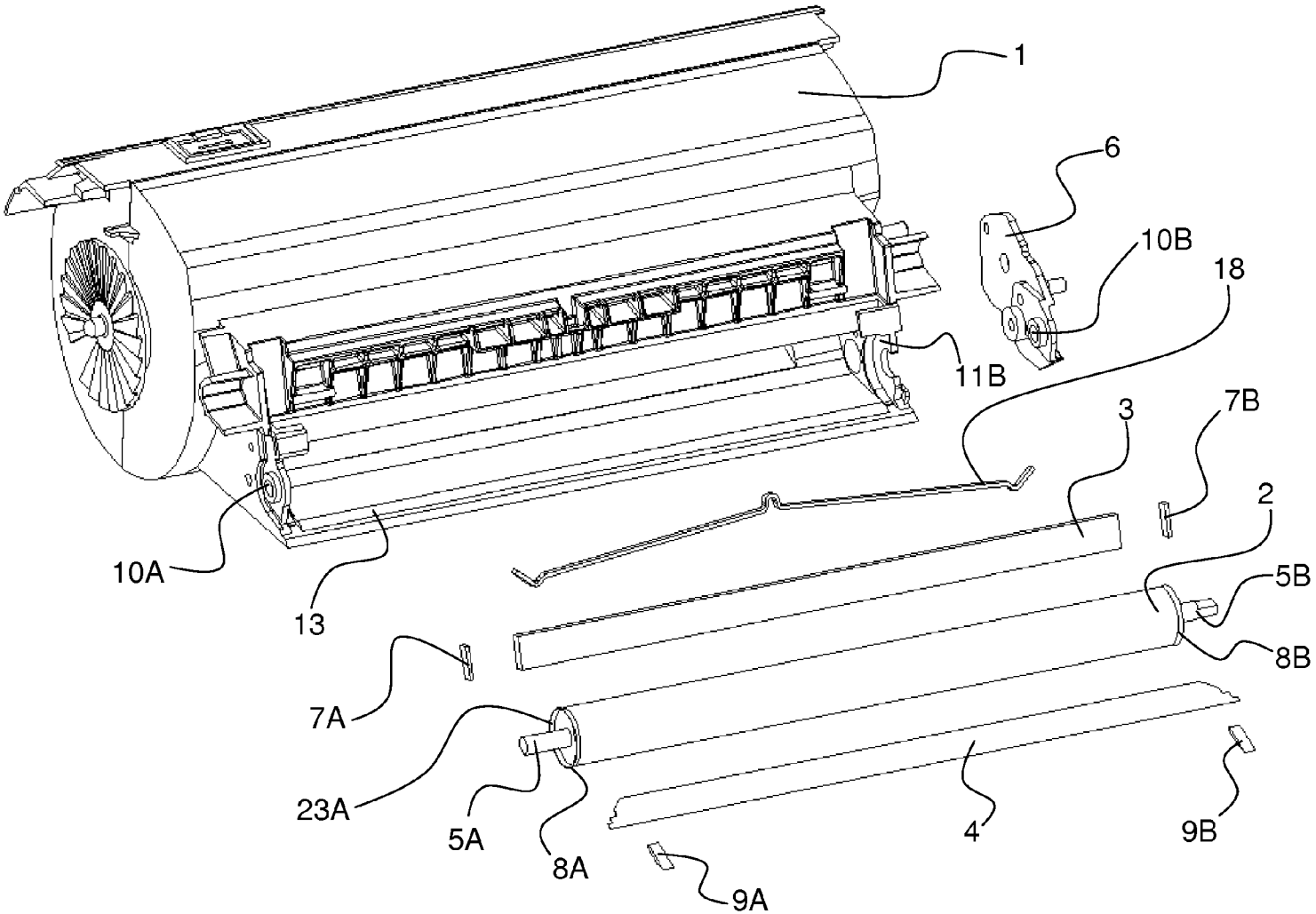
FIG. 3 is an exploded view of the toner hopper showing the developer roller with circumferential sealing lips along with the mating sealing components.
Figure 4:
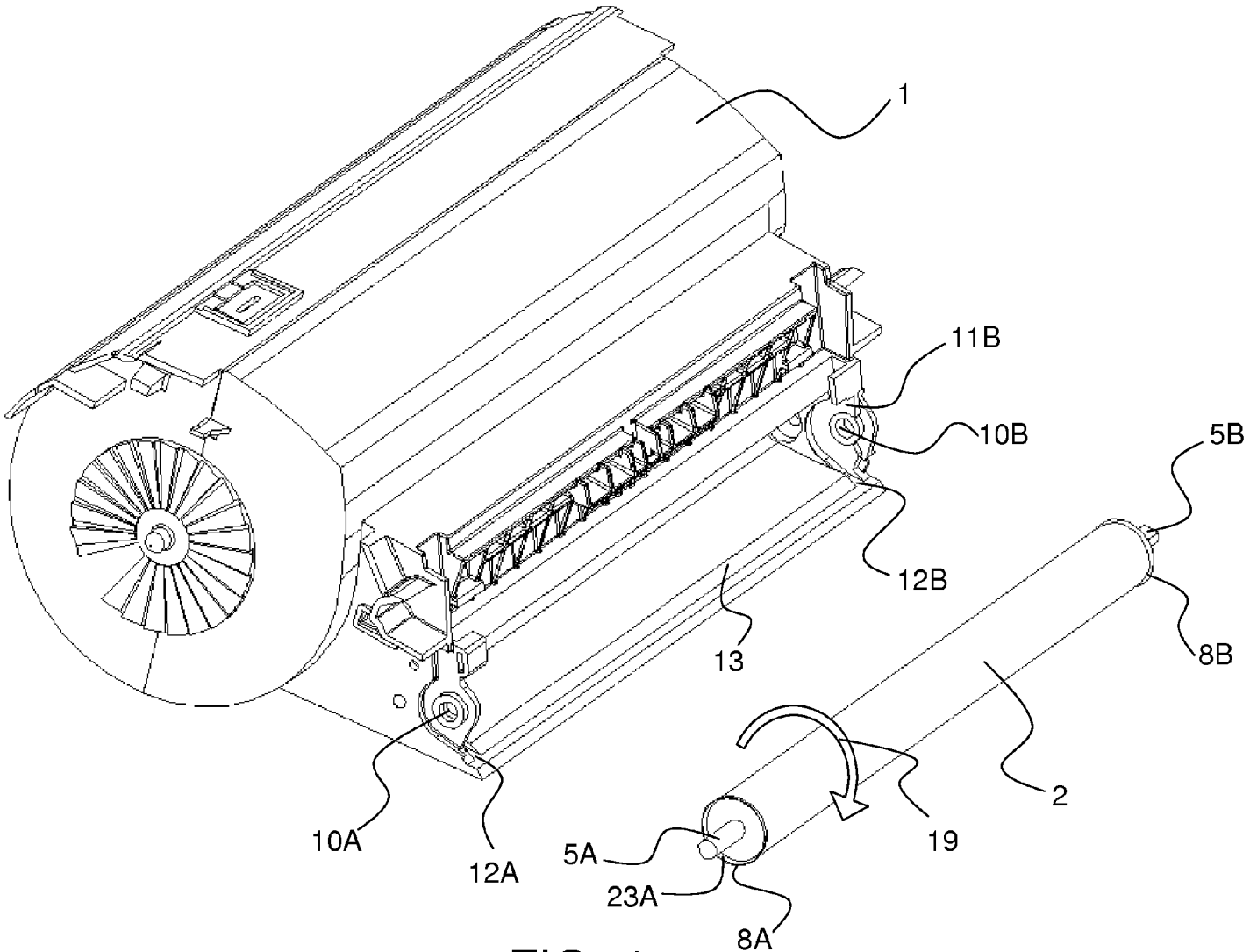
FIG. 4 is an exploded view of the toner hopper with some components removed showing the developer roller with circumferential sealing lips.
Figure 5:
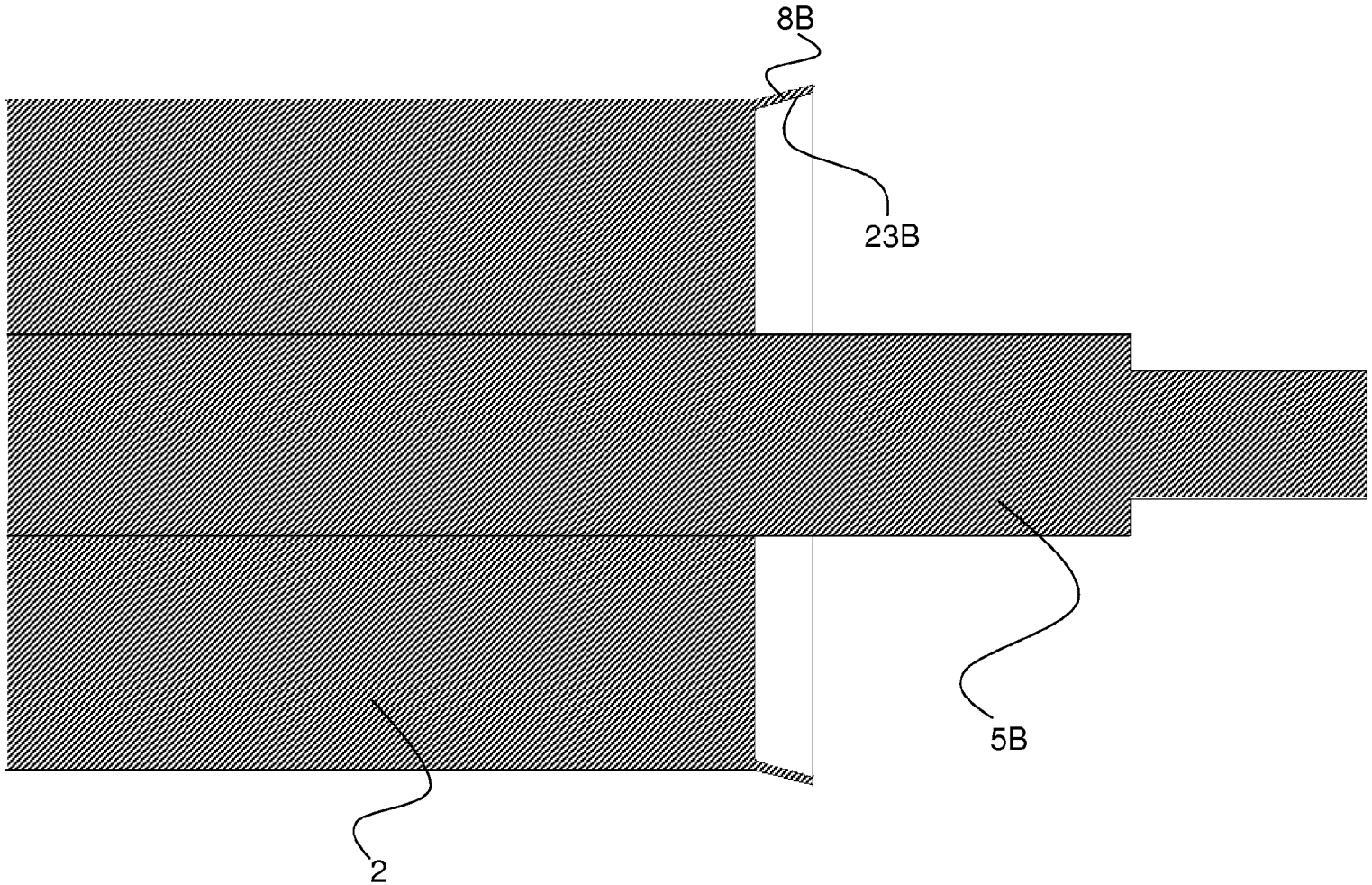
FIG. 5 is detailed cutaway view of the developer roller with circumferential sealing lips.

FIGS. 1 through 5 illustrate one embodiment of the invention wherein the toner exit area of toner hopper 1 is sealed using circumferential sealing lips 8A and 8B that protrude outward from the distal ends of developer roller 2. Developer roller 2 is rotatably mounted in hopper 1. Shaft ends 5A and 5B of developer roller 2 rotate in bushing surfaces 10A of hopper 1 and 10B of gear plate 6, in the direction indicated by arrow 19. The distal ends of developer roller 2 are sealed by circumferential sealing lips 8A and 8B of developer roller 2, which contact inner side walls 11A and 11B of hopper 1. As shaft ends 5A and 5B of developer roller 2 rotate in bushings 10A of hopper 1 and 10B of gear plate 6, inner surfaces 23A and 23B of circumferential sealing lips 8A and 8B of developer roller 2 contact side walls 11A and 11B of hopper 1, forming a seal between inner surfaces 23A and 23B of circumferential sealing lips 8A and 8B and side walls 11A and 11B. It is preferred that developer roller 2 is made of a flexible material such as urethane or rubber so that circumferential sealing lips 8A and 8B are able to flex and conform to inner side walls 11A and 11B of hopper 1. Also, circumferential sealing lips 8A and 8B can be in several shapes, including extending parallel to the central axis of developer roller 2 or being frusto-conical in a cone shape.

The upper portion of the toner exit area is sealed by doctor blade 3, which is biased downward towards developer roller 2 by leaf spring 18. In addition to sealing the upper portion of the toner exit area, doctor blade 3 acts to meter the amount of toner on developer roller 2. Electrically conductive foam end seals 7A and 7B are compressed between the ends of doctor blade 3 and inner side walls 11A and 11B of hopper 1 to seal the distal ends of doctor blade 3. Upper surfaces 22A and 22B of electrically conductive foam end seals 7A and 7B are flush with upper surface 21 of doctor blade 3 and the bottom surfaces of electrically conductive foam end seals 7A and 7B are positioned even with the bottom surface of doctor blade 3 so that electrically conductive foam end seals 7A and 7B contact the upper surface of developer roller 2 and act to meter the toner on developer roller 2 at the portion of developer roller 2 that is contacted by electrically conductive foam end seals 7A and 7B. The soft nature of the electrically conductive foam end seals allow them to contour to the circumferential sealing lips to ensure complete contact is made between the circumferential sealing lips and the electrically conductive foam end seals.

It is envisioned that doctor blade 3 can be made of a wide range of materials, including, but not limited to a rigid material such as steel, or a softer material such as a low durometer urethane. Although it preferred that electrically conductive foam end seals 7A and 7B are made of foam, it is envisioned that they could be made of any sealing material that also can effectively meter toner on developer roller 2.

The lower portion of the toner exit area is sealed by the lower sealing blade 4, which adheres to ramp 13 of toner hopper 1 and rests against the bottom of developer roller 2. Lower sealing blade 4 acts similar to a check valve, allowing the toner on developer roller 2 to enter back into toner hopper 1, while not allowing the toner contained in toner hopper 1 to exit. Foam end seals 9A and 9B sit in pockets 12A and 12B of hopper 1 and seal the area under the ends of lower sealing blade 4.

Figure 6:
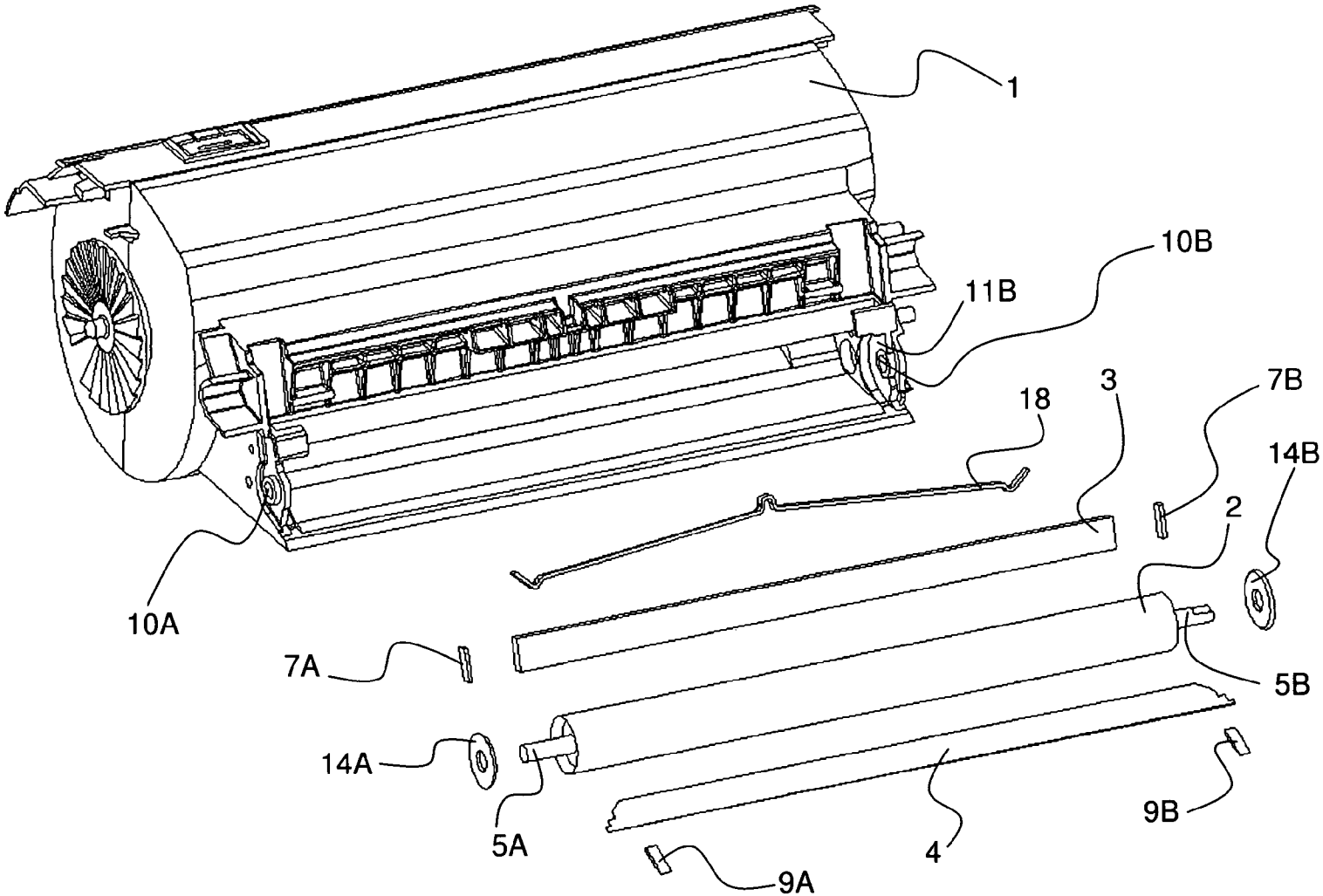
FIG. 6 is an exploded view of the toner hopper showing the developer roller with built in circumferential sealing cavities along with the mating sealing components.
Figure 7:
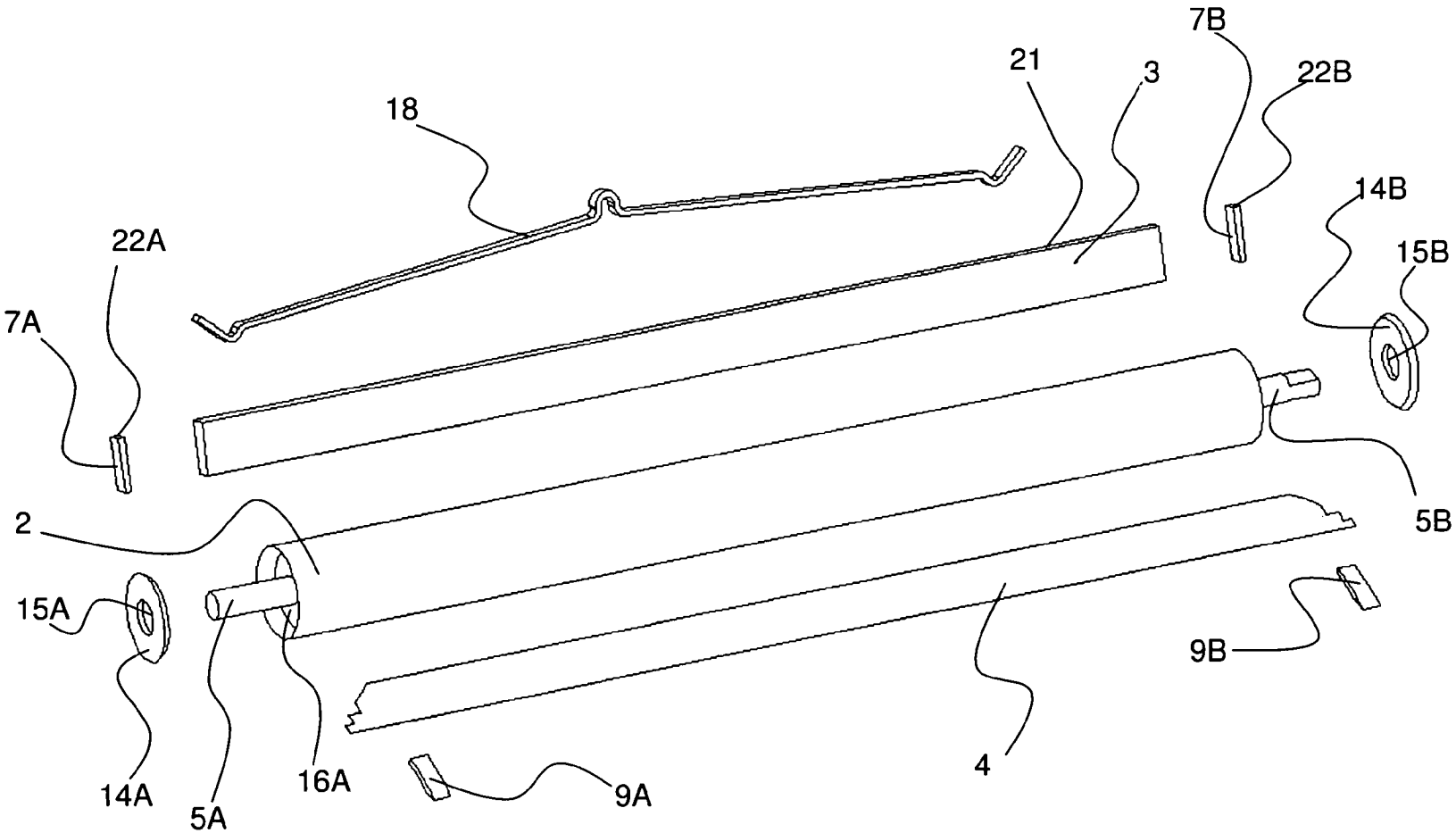
FIG. 7 is a detailed exploded view of the developer roller with circumferential sealing cavities along with the mating sealing components.
Figure 8:
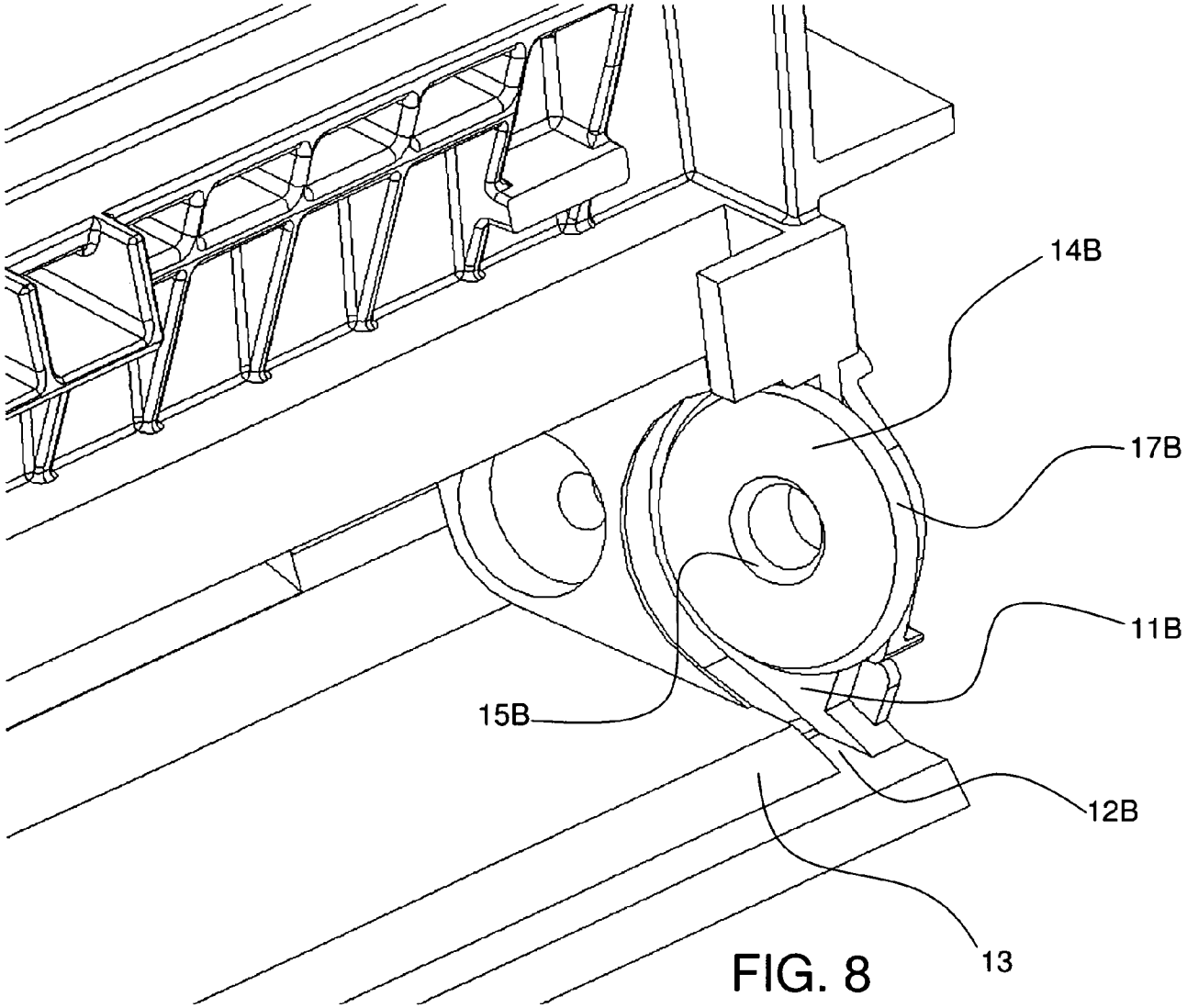
FIG. 8 is a detailed view of an end sealing disk installed in the toner hopper.
Figure 9:
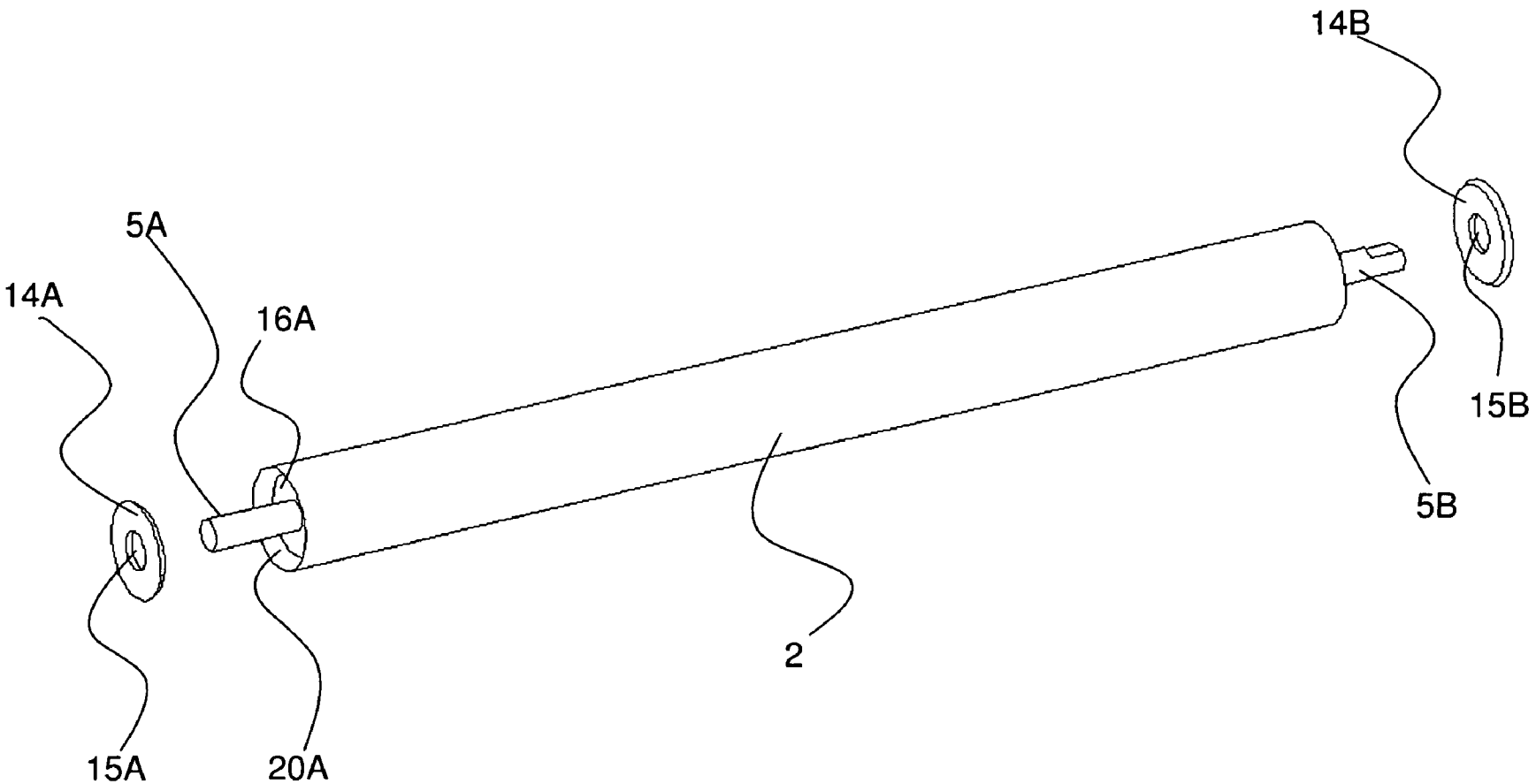
FIG. 9 is a detailed exploded view of the developer roller with circumferential sealing cavities and the end sealing disks.
Figure 10:
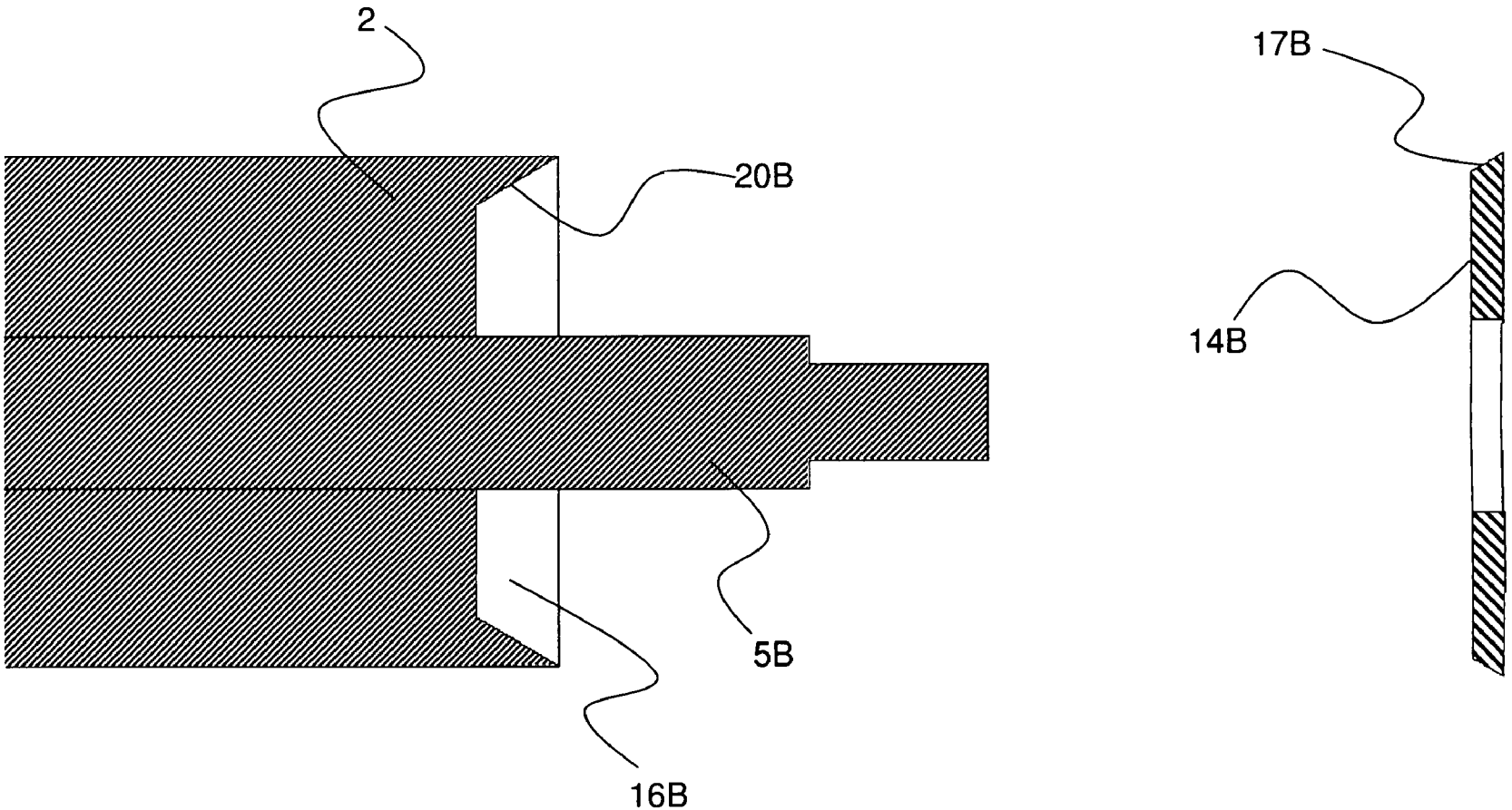
FIG. 10 is a detailed exploded cutaway view of the developer roller with circumferential sealing cavities and an end sealing disk.
Figure 11:
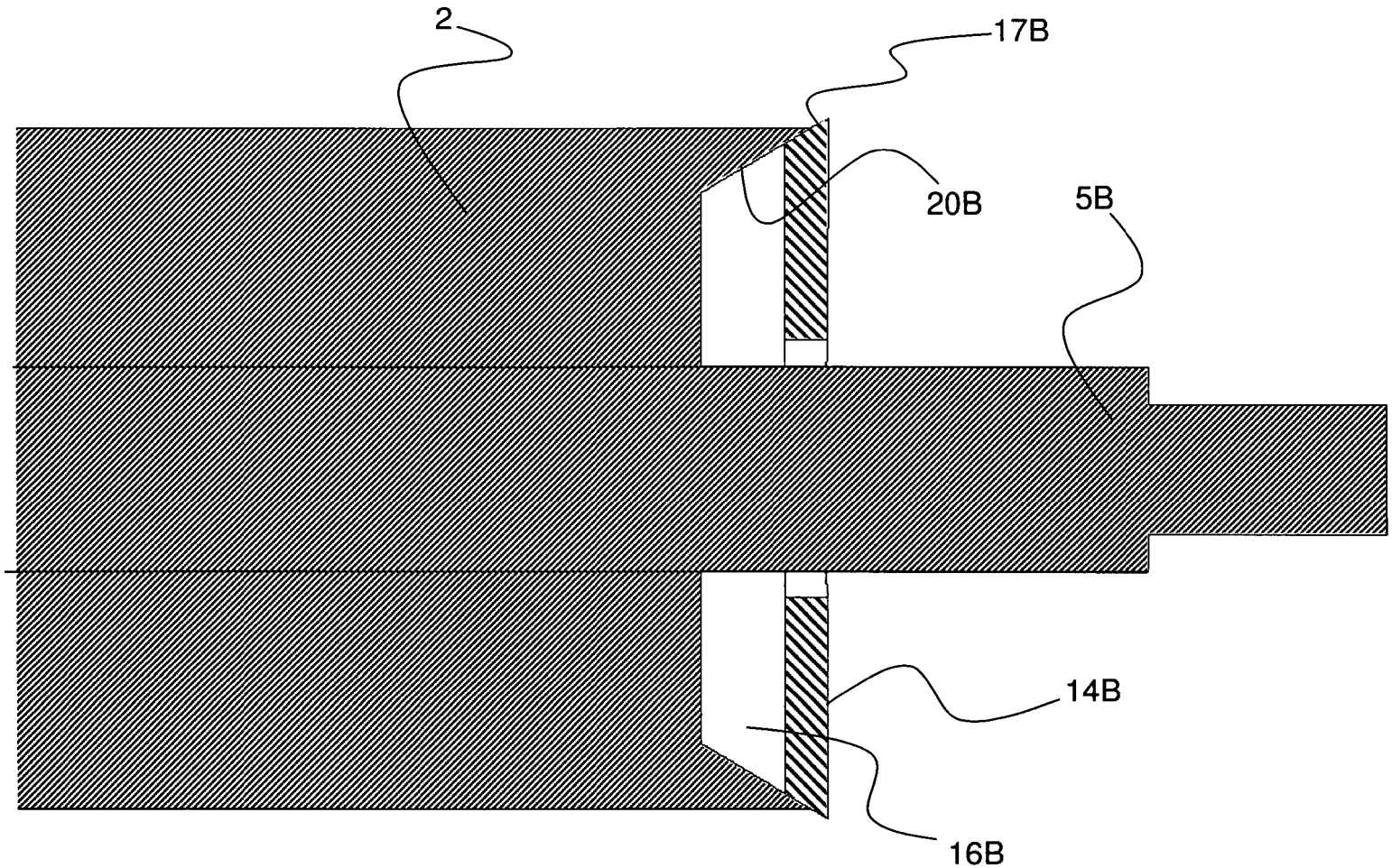
FIG. 11 is a detailed cutaway view of the developer roller with circumferential sealing cavities mating with an end sealing disk.
Figure 12:
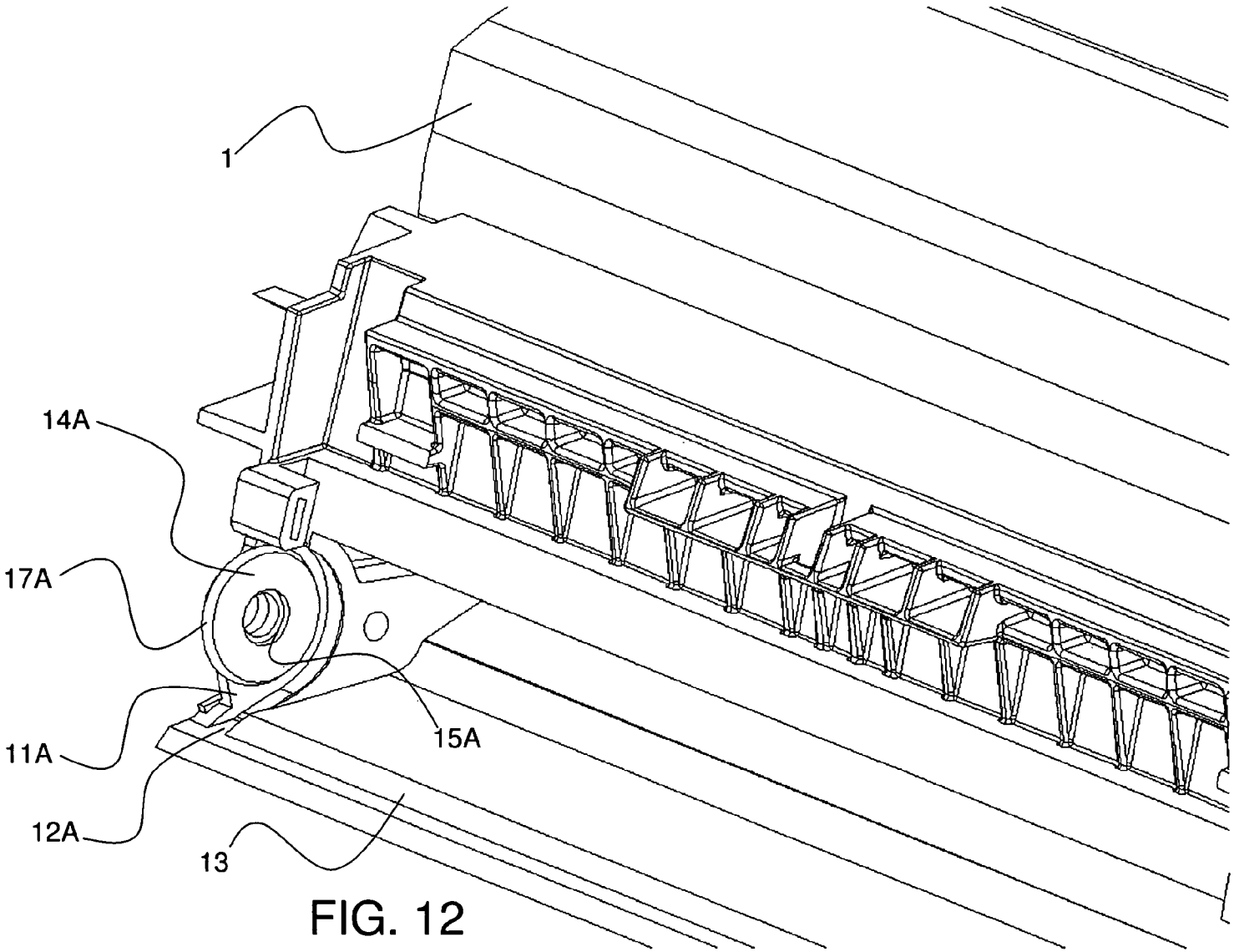
FIG. 12 is a detailed view of the toner hopper showing the positioning of an end sealing disk.

FIGS. 6 through 12 illustrate a second embodiment of the invention wherein the distal ends of developer roller 2 have circumferential sealing cavities 16A and 16B, which contact end sealing disks 14A and 14B that are mounted on inner side walls 11A and 11B of hopper 1. As shaft ends 5A and 5B of developer roller 2 rotate in bushings 10A of hopper 1 and 10B of gear plate 6, perimeter walls 20A and 20B of the circumferential sealing cavities 16A and 16B contact sealing surfaces 17A and 17B of end sealing disks 14A and 14B to seal the toner exit area at the distal ends of developer roller 2. End sealing disks 14A and 14B are mounted to inner side walls 11A and 11B so that toner cannot pass between the end sealing disks and the side walls. In another embodiment, sealing surfaces 17A and 17B are integrally formed in the housing of toner hopper 1. Shaft ends 5A and 5B of developer roller 2 pass through holes 15A and 15B of end sealing disks 14A and 14B. In this embodiment it is also preferred that developer roller 2 is made of a flexible material so that circumferential sealing cavities 16A and 16B conform to sealing surfaces 17A and 17B.

It is preferred that perimeter walls 20A and 20B of circumferential sealing cavities 16A and 16B are at an angle between 10 degrees and 80 degrees in relation to the central axis of developer roller 2, but an angle within this range is not required.

Although the preferred embodiment describes a toner cartridge, the invention can be used in any type of imaging cartridge that utilizes a process roller at the printing agent exit area of the cartridge, including ink jet cartridges. Additionally, the term, "printing agent," refers to any pigment used by an imaging machine to form an image, including but not limited to ink or toner.

It will be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween. Now that the invention has been described,

What is claimed is:

1. An imaging cartridge, comprising:

a housing containing a printing agent;

a process roller rotatably mounted at the printing agent exit area of said housing;

said process roller comprising a circumferential sealing lip protruding outward from a distal end of said process roller;

said circumferential sealing lip being integrally formed in said process roller;

said circumferential sealing lip extending 360 degrees around the circumference of said distal end of said process roller;

said circumferential sealing lip comprising an inner surface;

said inner surface of said circumferential sealing lip disposed to contact a sealing surface located in said housing at the distal end of said process roller, whereby said circumferential sealing lip forms a seal against said sealing surface to seal said printing agent inside of said housing.

2. The imaging cartridge of claim 1, wherein:

said circumferential sealing lip is frusto-conical in shape.

3. The imaging cartridge of claim 1, further comprising:

a doctor blade in contact with said process roller.

4. The imaging cartridge of claim 3, further comprising:

an end seal located between a distal end of said doctor blade and a surface of said housing.

5. The imaging cartridge of claim 4, further comprising: said end seal comprising an electrically conductive resilient material.

6. The imaging cartridge of claim 1, further comprising: a lower sealing blade in contact with said process roller.

7. The imaging cartridge of claim 6, further comprising: an end seal mounted in said housing at an end of said lower sealing blade.

8. The imaging cartridge of claim 7, further comprising: said end seal located between said lower sealing blade and a surface of said housing.

9. The imaging cartridge of claim 1, further comprising: said sealing surface being integrally formed on a wall of said housing.

* * * * *